US005989011A

United States Patent [19]

Caruso et al.

[11] Patent Number: 5,989,011

[45] Date of Patent: Nov. 23, 1999

[54] BURNER CONTROL SYSTEM

[76] Inventors: Pat Caruso; Kevin Merritt, both of 866 Main Street East, Hamilton, ON, Canada, L8M 1L9

[21] Appl. No.: 09/115,601

[22] Filed: Jul. 15, 1998

Related U.S. Application Data

[60] Provisional application No. 60/053,056, Jul. 18, 1997.

[51] Int. Cl.[6] ..... F23N 5/24

[52] U.S. Cl. ..... 431/12; 431/90; 126/91 A

[58] Field of Search ..... 431/12, 90; 126/91 A

[56] References Cited

U.S. PATENT DOCUMENTS

| | | | |
|---|---|---|---|
| 2,147,568 | 2/1939 | Barber | 431/90 |
| 2,594,430 | 4/1952 | Hansen | 431/90 |
| 3,741,710 | 6/1973 | Nelson | 431/90 |
| 5,520,533 | 5/1996 | Vrolijk | 431/90 |

FOREIGN PATENT DOCUMENTS

| | | | |
|---|---|---|---|
| 676497 | 1/1991 | Switzerland | 431/90 |

*Primary Examiner*—Carroll Dority

[57] ABSTRACT

The present invention, a burner control system for use with a radiant tube heating system having a source of compressed air and compressed fuel, the burner control system includes a burner for combustion of an air/fuel mixture; a mixing block for receiving and mixing air and fuel and communicating the combustible air and fuel mixture to the burner; the source of compressed air communicating air under pressure to the mixing block and to an air regulator; the air regulator, receiving air from the source of compressed air and for discharging and communicating pressure controlled air to a fuel regulator; and the fuel regulator for receiving fuel under pressure and discharging and communicating a pressure regulated supply of fuel to the mixing block, the fuel regulator also communicating with and operably connected to the pressure controlled air, wherein the pressure of the fuel communicated to said mixing block is controlled by and a function of the pressure controlled air communicated to said fuel regulator.

17 Claims, 1 Drawing Sheet

BURNER CONTROL SYSTEM

This application claims benefit of Provisional Application No. 60/053,056 filed Jul. 18, 1997.

FIELD OF THE INVENTION

The present invention relates to fuel burner control systems and more particularly to fuel burner control system for radiant tube heating devices.

BACKGROUND OF THE INVENTION

Current burner control systems normally fire at a predetermined firing rate and control the temperature normally by turning the burner on and off. Recently there have been some burner control systems developed which are able to vary the firing rates discretely by using a plurality of predetermined fuel pressures for accommodating various demands of heating. Therefore, rather than turning the burner completely on and off, the burner is able to operate at normally two pre selected firing rates. One such burner control system is described in U.S. Pat. No. 5,353,986 filed on Jun. 15, 1993 and titled "Demand Radiant Heating System" by Joseph B. Wortman. This particular burner control system which is used for a radiant tube heating application, utilizes a multi stage or more precisely a two stage fuel regulator in order to achieve two discrete firing rates. This burner control system achieves a plurality of predetermined pressures, however, is not able to continuously variably control the fuel pressure and therefore the firing rate over a predetermined range of firing rates.

In some applications it is desirable to be able to continuously variably control the firing rate and hence it is desirable to have a burner control system which is able to continually variably control the fuel pressure for continuously variable firing rates.

SUMMARY OF THE INVENTION

The present invention relates to apparatus for controlling gas burners. The subject apparatus a burner control system comprises a burner having an inlet end for receiving air and fuel and an exit end for discharging the air/fuel mixture for combustion. A mixing means receives and mixes air and fuel and communicates the air and fuel to the burner. A blower continually communicates air under pressure to the mixing means and also to an air regulator means. The air regulator means, receives air from the blower, and continuously controls the air pressure of the air received from the blower and discharges pressure controlled air which is communicated to a gas regulator means. The gas regulator means receives fuel under pressure and discharges and communicates a pressure regulated supply of fuel to the fuel mixing means. The fuel pressure is regulated over a continuously variable range of pressures by the gas regulator means which utilizes pressure controlled air to continuously regulate the fuel pressure.

Preferably the gas regulator means comprises an air chamber separated from a fuel chamber by a diaphragm connected to a gas valve, such that pressure controlled air received in the air chamber impinges upon the diaphragm which actuates the valve thereby varying the discharge gas pressure.

In a presently preferred embodiment of the present invention a burner control system for use with a radiant tube heating system having a source of compressed air and compressed fuel the burner control system comprises, a burner for combustion of an air/fuel mixture; a mixing means for receiving and mixing air and fuel and communicating the combustible air and fuel mixture to the burner; the source of compressed air communicating air under pressure to the mixing means and to an air control means; the air control means, receiving air from the source of compressed air and for discharging and communicating pressure controlled air to a fuel regulator means; and the fuel regulator means for receiving fuel under pressure and discharging and communicating a pressure regulated supply of fuel to the mixing means, the fuel control means also communicating with and operably connected to the pressure controlled air, wherein the pressure of the fuel communicated to said mixing means is controlled by and a function of the 0pressure controlled air communicated to said fuel regulator means.

Preferably said air control means comprises an air regulator for receiving air from said source of compressed air and discharging pressure controlled air to said fuel regulator means, said air regulator selectively setting the air pressure of the pressure controlled air communicated to said fuel regulator means.

Preferably said air control means further comprises a controller for communicating with said air regulator, for operatively controlling the air pressure setting of said air regulator.

Preferably the pressure of said source of compressed air is less than 1.5 inches of water column and greater than 0.5 inches of water column, and said air regulator selectively controls said pressure controlled air between 0.0 and 1.5 inches of water column.

Preferably said source of compressed air is a high volume low pressure blower providing an air pressure between 0.5 and 1.5 inches of water column.

Preferably the fuel regulator means comprises a fuel regulator including a regulator housing for receiving pressure controlled air from said air regulator and for receiving fuel from said source of compressed fuel.

Preferably the fuel control means includes an air chamber defined in said fuel regulator housing communicating with said pressure controlled air and separated from a fuel chamber also defined in said fuel regulator housing, such that said air chamber and said fuel chamber are separated by a diaphragm, wherein said diaphragm is operatively actuated by variations in air pressure in said air chamber for operatively controlling the fuel pressure communicated to said mixing means.

Preferably the diaphragm is operatively connected to a fuel valve mounted in said fuel chamber such that variations in air pressure is said air chamber result in said diaphragm opening and closing said valve thereby controllably varying the fuel pressure communicated to said mixing means.

Preferably said air regulator regulates the pressure controlled air over a continuously variable range of pressures.

Preferably said air regulator regulates the pressure of the pressure controlled air between 0 (zero) inches of water column and the maximum air pressure provided by the source of compressed air.

Preferably said controller is a thermostat communicating electrical signals to said air regulator to operably control the pressure of the pressure controlled air communicated by the air regulator, to the fuel regulator means.

In another embodiment the present invention includes a method of regulating the firing rate of a burner used in a radiant tube heating system having a source of compressed air and fuel, the regulating method comprising the steps of:

(a) supplying air and fuel to a mixing means for communicating a combustible mixture of air and fuel to the burner;

(b) supplying air from said source of compressed air to said mixing means and to an air control means;

(c) supplying fuel to a fuel regulator means which communicates pressure regulated fuel to said mixing means, wherein the air control means operably controls the fuel pressure communicated to said mixing means.

Preferably said air control means, receiving air from the source of compressed air and for discharging and communicating pressure controlled air to said fuel regulator means; and said fuel regulator means for receiving fuel under pressure and discharge and communicating a pressure regulated supply of fuel to the mixing means, the fuel control means also communicating with and operably connected to the pressure controlled air, wherein the pressure of the fuel communicated to said mixing means is controlled by and a function of the pressure controlled air communicated to said fuel regulator means.

BRIEF DESCRIPTION OF THE DRAWINGS

The invention will now be described by way of example only, with references to the following drawings in which.

DETAILED DESCRIPTION OF THE PREFERRED EMBODIMENT

Figure 1:
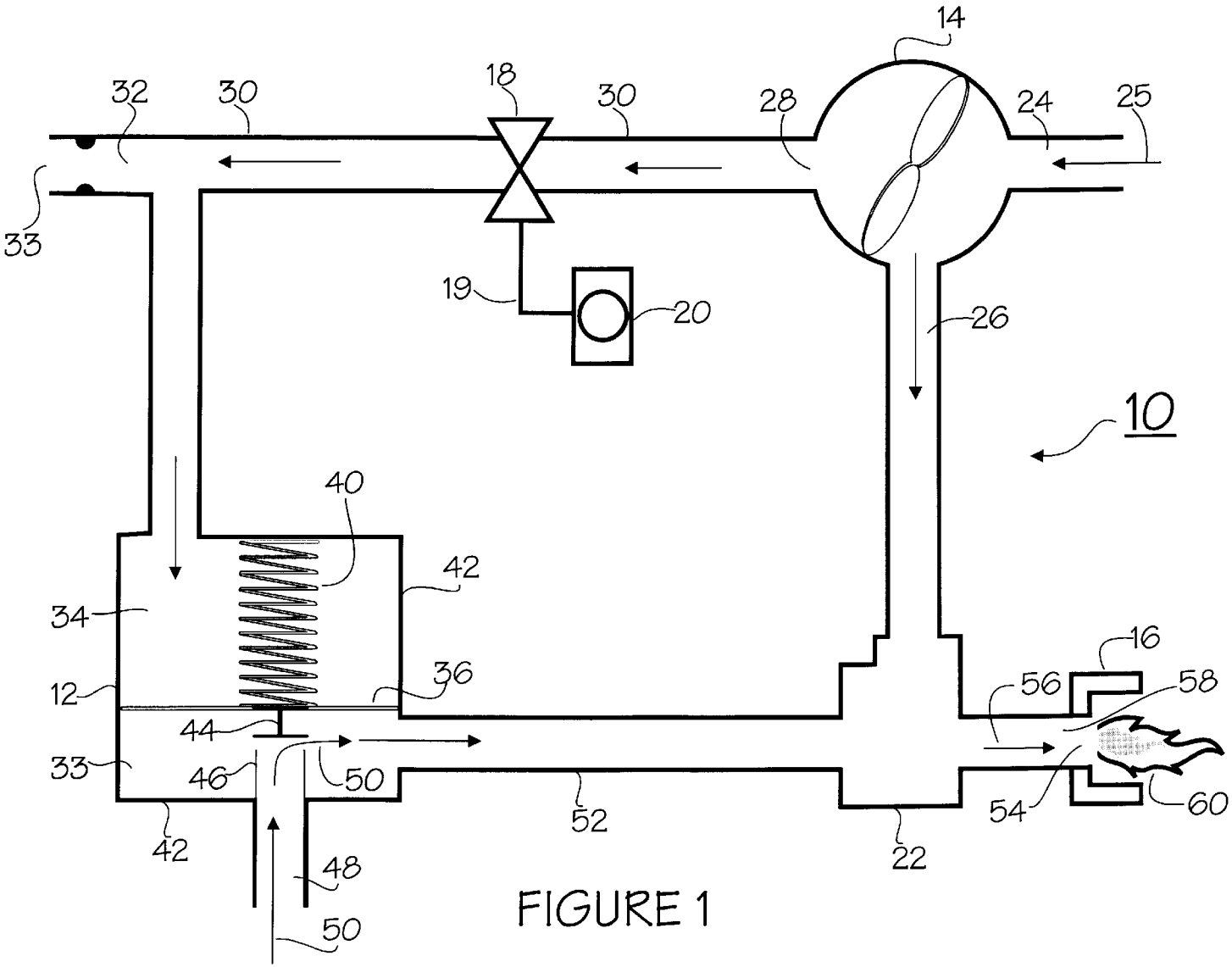
FIG. 1 is a schematic flow diagram of a burner control system made in accordance with the subject invention.

FIG. 1 illustrates a preferred embodiment of a burner control system which is made in accordance with the subject invention. The burner control system is shown generally as 10 and comprises fuel regulator 12, blower 14, burner 16, air regulator 18, controller 20 and mixing block 22.

Blower 14 has an air inlet 24 for receiving fresh air 25 which is then discharged by blower 14 through combustion air outlet 26 for the supply of combustion air to mixing block 22 and ultimately to burner 16 and also through control air outlet 28 to air regulator 18 which functions as we will see later to control fuel regulator 12. The majority of air exiting from blower 14 is discharged via combustion air outlet 26. Control air outlet 28 is a minor air outlet used for the regulation of fuel regulator 12. Blower 14 is normally a squirrel cage type blower or any other type of blower known in this type of industry. For radiant tube heating type applications the blower will normally produce an air pressure of 0.5 inches of water column. However, for the present invention, it is preferable to have a blower supplying one to two inches of water column and for larger units anywhere up to five inches of water column or more.

Air regulator 18 receives air from control air outlet 28 and is designed to regulate the air pressure over a continuously variable range of pressure and communicate pressure controlled air 32 from air regulator 18 to fuel regulator 12 as described below. A vent 33 is located between air regulator 18 and fuel regulator 12 for helping to maintain uniformity of pressure of pressure controlled air 32 entering air chamber 34. The air exiting from air regulator 18 is pressure controlled air 32 which typically ranges from 0 to 2 inches of water column. Air regulator 18 may be a plunger type valve, a pinch valve, a screw type valve or any other valve known in the art for controlling air pressure. For example control air conduit 30 may be plastic deformable tubing which may cooperate with air regulator 18 which has a motor driven cam which impinges upon control air conduit 30 deforming it and therefore continuously varying the flow and pressure of pressure controlled air 32 through air conduit 30 over a continuous range of values. Pressure controlled air 32 exiting from air regulator 18 enters air chamber 34 of regulator housing 42 of fuel regulator 12 and also exits via vent 33. Controller 20 may be an electronic thermostat and/or timer or any other controlling device which is suitable for this particular application. Controller 20 is in communication with air regulator 18 via communication line 19 and determines the range of pressures over which pressure controlled air 32 is controlled.

Regulator housing 42 of fuel regulator 12 has two chambers separated by diaphragm 36, namely air chamber 34 and fuel chamber 38. Air chamber 34 has a spring 40 or any other means for resiliently biasing diaphragm 36 relative to regulator housing 42. Diaphragm 36 is rigidly connected to valve 44 which cooperates with valve seat 46. One can see that as the air pressure of pressure controlled air 32 rises the pressure on diaphragm 36 increases and valve 44 is urged closer to valve seat 46 thereby restricting the flow of fuel 50 through valve 44. Fuel chamber 38 has a fuel inlet 48 for receiving fuel 50 which flows out over valve seat 46 into gas chamber 38 and into manifold 52. Fuel received through fuel inlet 48 and into fuel regulator 12 is communicated via manifold 52 to mixing block 22 where air 25 received from blower 14 is mixed with fuel 50 received from fuel regulator 12. The fuel air mixture created in mixing block 22 is then communicated to inlet 54 of burner 16 via burner supply conduit 56 and exits burner 16 at exit end 58 for combustion, thereby producing flame 60.

In use, air 25 received through air inlet 24 and by blower 14 is pressurized (in for example radiant tube applications) to approximately one to two inches of water column which is the air pressure received by mixing block 22. Air regulator 18 also receives air pressurized to one to two inches of water column from blower 14 and is able to continuously variably regulate the air pressure from zero to two inches of water column, thereby discharging pressure controlled air 32 from air regulator 18. Excess pressure controlled air 32 is discharged by vent 33. Controller 20 communicating and sending signals to air regulator 18 regulates the range over which air regulator 18 operates and controls air regulator 18 and therefore the pressure of pressure controlled air 32. Pressure controlled air 32 is received by air chamber 34 of fuel regulator 12 and continuously variably regulates the position of valve 44 relative to valve seat 46. Therefore fuel regulator 12 can continuously variably regulate the fuel exit pressure in manifold 52. Diaphragm 36 continuously variably displaces, valve 44 in proportion to the pressure of pressure controlled air 32 entering air chamber 34. In mixing block 22 air received from blower 14 is mixed with fuel 50 received from fuel regulator 12. Mixing block 22 is of the standard type known in the art for mixing gaseous fuels with air suitable for combustion in a burner. The fuel air mixture exiting for mixing block 22 communicates with burner 16 via burner supply conduit 56 and is ignited and combusted proximate exit end 58 of burner 16.

It must be emphasized that the components shown in FIG. 1 are schematic in nature and are used to illustrate the concept of this burner control system. The selection of the type of blower 14, type of mixing block 22, type of air regulator 18, type of controller 20 depends to a large extent on the application for which this burner control system is to be used with. As mentioned above in radiant tube heating system applications, blower 14 is normally of the squirrel cage type design which will produce one to two inches of water column of air pressure, air regulator 18 may be an electrically controlled screw type air regulator or cam type air regulator. Controller 20 may be a thermostat or a timer or any other type of controller which is desirable for the application of this burner control system. Fuel regulator 12 is similar to existing fuel regulators except for the modification that air chamber 34 which is normally just vented to atmospheric pressure has in this case a pressure controlled air supply 32 which leads into air chamber 34 for continuously variably controlling the displacement of diaphragm 36, which in turn continuously variably controls the fuel exit pressure in manifold 52.

The firing rate is normally controlled within the range 70 to 100% of maximum. The greater the maximum pressure obtainable from blower 14 the easier it is to obtain control over a greater firing rate range. For example, if the blower 14 can produce five inches of water column pressure the firing rate can be controlled more easily within the range 50 to 100% of maximum.

It should accordingly be apparent to persons skilled in the art that various modifications and adaptations of the structure described above are possible without departure from the spirit of the invention the scope of which is defined in the appended claims.

I claim:

1. A burner control system for use with a radiant tube heating system having a source of compressed air and compressed fuel, the burner control system comprising:

(a) a burner for combustion of an air/fuel mixture;

(b) a mixing means for receiving and mixing air and fuel and communicating the combustible air and fuel mixture to the burner;

(c) the source of compressed air communicating air under pressure to the mixing means and to an air control means;

(d) the air control means, receiving air from the source of compressed air and for discharging and communicating pressure controlled air to a fuel regulator means; and (e) the fuel regulator means for receiving fuel under pressure and discharging and communicating a pressure regulated supply of fuel to the mixing means, the fuel control means also communicating with and operably connected to the pressure controlled air, wherein the pressure of the fuel communicated to said mixing means is controlled by and a function of the pressure controlled air communicated to said fuel regulator means;

(f) wherein said air control means comprises an air regulator for receiving air from said source of compressed air and discharging pressure controlled air to said fuel regulator means, said air regulator selectively setting the air pressure of the pressure controlled air communicated to said fuel regulator means;

(g) wherein said air control means further comprises a controller for communicating electrical signals to said air regulator, for operatively controlling the air pressure of said pressure controlled air communicated from said air regulator to said fuel regulator means.

2. The burner control system claimed in claim 1, wherein said controller comprises a thermostat communicating electrical signals to said air regulator to operably control the pressure of the pressure controlled air communicated by the air regulator, to the fuel regulator means.

3. The burner control system claimed in claim 2, wherein the pressure of said source of compressed air is less than 1.5 inches of water column and greater than 0.5 inches of water column, and said air regulator selectively controls said pressure controlled air between 0.0 and 1.5 inches of water column.

4. The burner control system claimed in claim 3, wherein said source of compressed air is a high volume low pressure blower providing an air pressure between 0.5 and 1.5 inches of water column.

5. The burner control system claimed in claim 2, wherein the fuel regulator means comprises a fuel regulator including a regulator housing for receiving pressure controlled air from said air regulator and for receiving fuel from said source of compressed fuel.

6. The burner control system claimed in claim 5, wherein the fuel control means includes an air chamber defined in said fuel regulator housing communicating with said pressure controlled air and separated from a fuel chamber also defined in said fuel regulator housing, such that said air chamber and said fuel chamber are separated by a diaphragm, wherein said diaphragm is operatively actuated by variations in air pressure in the pressure controlled air received by said air chamber for operatively controlling the fuel pressure communicated to said mixing means.

7. The burner control system claimed in claim 6, wherein the diaphragm is operatively connected to a fuel valve mounted in said fuel chamber such that variations in air pressure is said air chamber result in said diaphragm opening and closing said valve thereby controllably varying the fuel pressure communicated to said mixing means.

8. The burner control system claimed in claim 2, wherein said air regulator regulates the pressure controlled air over a continuously variable range of pressures.

9. The burner control system claimed in claim 8, wherein said air regulator regulates the pressure of the pressure controlled air between 0 (zero) inches of water column and the maximum air pressure provided by the source of compressed air.

10. A method of regulating the firing rate of a burner used in a radiant tube heating system having a source of compressed air and fuel, the regulating method comprising the steps of:

(a) supplying air and fuel to a mixing means for communicating a combustible mixture of air and fuel to the burner;

(b) supplying air from said source of compressed air to said mixing means and also to an air control means, wherein the air control means communicates pressure controlled air to a fuel regulator means;

(c) supplying fuel to the fuel regulator means which communicates pressure regulated fuel to said mixing means;

(d) supplying pressure controlled air to the fuel regulator means from the air control means, and pressure controlled air for controlling and regulating the fuel pressure communicated to said mixing means;

(e) communicating electrical signals from a controller to said air regulator for operatively controlling the air pressure of the pressure controlled air communicated from said air control means to said fuel regulator means.

11. The regulating method claimed in claim 10, wherein said controller comprises a thermostat communicating electrical signals to said air regulator to operably control the pressure of the pressure controlled air communicated by the air control means, to the fuel regulator means.

12. The regulating method claimed in claim 11, wherein said air control means comprises an air regulator for receiving air from said source of compressed air and discharging pressure controlled air to said fuel regulator means, said air regulator selectively setting the air pressure of the pressure controlled air communicated to said fuel regulator means.

13. The regulating method claimed in claim 11, wherein the pressure of said source of compressed air is less than 1.5 inches of water column and greater than 0.5 inches of water column, and said air regulator selectively controls said pressure controlled air between 0.0 and 1.5 inches of water column.

14. The regulating method claimed in claim 13, wherein said source of compressed air is a high volume low pressure blower providing an air pressure between 0.5 and 1.5 inches of water column.

15. The regulating method claimed in claim 10, wherein the fuel regulator means comprises a fuel regulator including a regulator housing for receiving pressure controlled air from said air regulator and for receiving fuel from said source of compressed fuel.

16. The regulating method claimed in claim 15, wherein the fuel regulator includes an air chamber defined in said regulator housing communicating with said pressure controlled air and separated from a fuel chamber also defined in said regulator body, such that said air chamber and said fuel chamber are separated by a diaphragm, wherein said diaphragm is operatively actuated by variations in air pressure in said air chamber for operatively varying the fuel pressure communicated to said mixing means.

17. The regulating method claimed in claim 16, wherein the diaphragm is operatively connected to a fuel valve mounted in said fuel chamber such that variations in air pressure is said air chamber result in said diaphragm opening and closing said valve thereby controllably varying the fuel pressure communicated to said mixing means.

* * * * *